United States Patent [19]

Wilson

[11] 4,062,339

[45] Dec. 13, 1977

[54] BOWSTRING DRAW AND RELEASE MECHANISM

[76] Inventor: Hugh R. Wilson, 10840 S.W. 120th St., Miami, Fla. 33176

[21] Appl. No.: 658,837

[22] Filed: Feb. 17, 1976

[51] Int. Cl.[2] ..... F41B 5/00

[52] U.S. Cl. ..... 124/35 A

[58] Field of Search ..... 124/35 A, 31, 23 R, 124/24 R

[56] References Cited

U.S. PATENT DOCUMENTS

| | | | |
|---|---|---|---|
| 2,982,279 | 5/1961 | Pursley | 124/35 A |
| 3,446,200 | 5/1969 | Gross | 124/35 A X |
| 3,461,852 | 8/1969 | Brothers | 124/35 A |
| 3,818,888 | 6/1974 | Keeney et al. | 124/35 A |
| 3,952,720 | 4/1976 | Wilson | 124/35 A |
| 3,954,095 | 5/1976 | Lewis | 124/35 A |

*Primary Examiner*—Richard C. Pinkham
*Assistant Examiner*—William R. Browne

[57] ABSTRACT

This invention is that of a Bowstring Release Device to be used in archery for drawing a bowstring back and releasing same to propel an arrow to the target. The structure comprises a body, a swinging holding member, a sliding plunger to retain the holding member in a holding position, a triggering member to hold the plunger in a retaining position. Upon movement of the triggering member the plunger is pulled forward by the force of the bowstring, releasing the holding member and the bowstring. A rope loop is provided to avoid direct contact of the holding member with the bowstring, if desired, and an alternate arrangement of the mechanism allows the handle to be mounted on the triggering member, said handle also including a safety locking device.

7 Claims, 7 Drawing Figures

BOWSTRING DRAW AND RELEASE MECHANISM

FIELD OF THE INVENTION

The device is intended for use in archery target shooting or for use in bowhunting.

DESCRIPTION OF THE PRIOR ART

Although many bowstring release devices have appeared over the years, many of them very crudely made, some of the most important and desirable features have been overlooked or omitted. This invention provides a new and reliable releasing device which is compact, light in weight, easy to attach to the bowstring, can be used in either hand, has a trigger than can be repositioned without modification of the device and allowing the user to use his third finger in one position of the trigger or to use his thumb to trigger the release when the trigger is moved to the alternate position in the body of the device. Further, the construction allows the device to be cheaply produced. The device is quickly and easily locked by simply pushing the retaining plunger into the body while the bowstring holding member is engaged with the groove in the plunger.

REFERENCE

Reference is made to pending application Ser. No. 567,056 now U.S. Pat. No. 3,952,720, patented Apr. 27, 1976, filed on Apr. 11, 1975 by the inventor herein.

SUMMARY OF THE INVENTION

It is an object of this invention to provide a new and reliable bowstring release device that is cheap to manufacture.

Another object of this invention is to provide the simple and easy use of the retaining plunger which can be manually moved to a locking position by an easy pressure of the tip of the user's thumb or finger.

A further object of the invention is to provide a new and reliable bowstring device with the handle mounted on the triggering means thereby allowing the user to release a bowstring by a movement of the wrist. The novelty of this invention will become more apparent in the specification and claims.

A BRIEF DESCRIPTION OF THE DRAWINGS

DESCRIPTION OF THE PREFERRED EMBODIMENT

Figure 1:
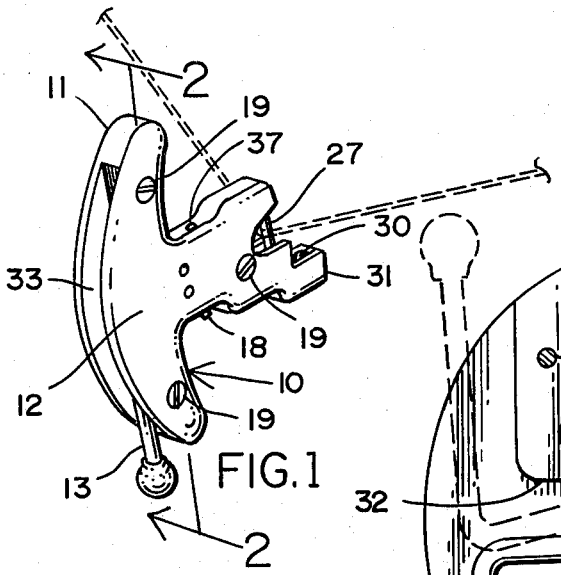
FIG. 1 shows the device attached to the bowstring with the bowstring shown in broken lines.
Figure 2:
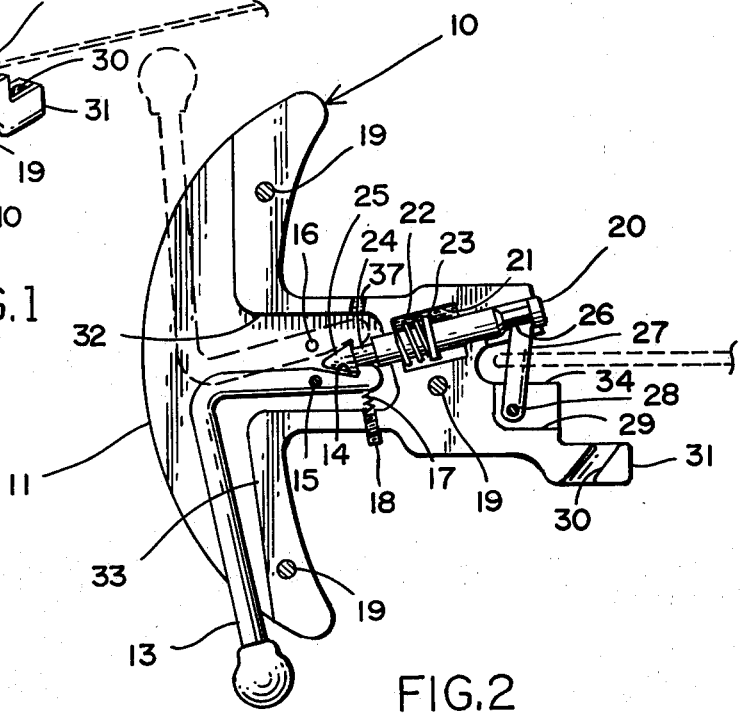
FIG. 2 shows the component parts of the mechanism in a first or locked position. The bowstring is shown by the broken lines.
Figure 3:
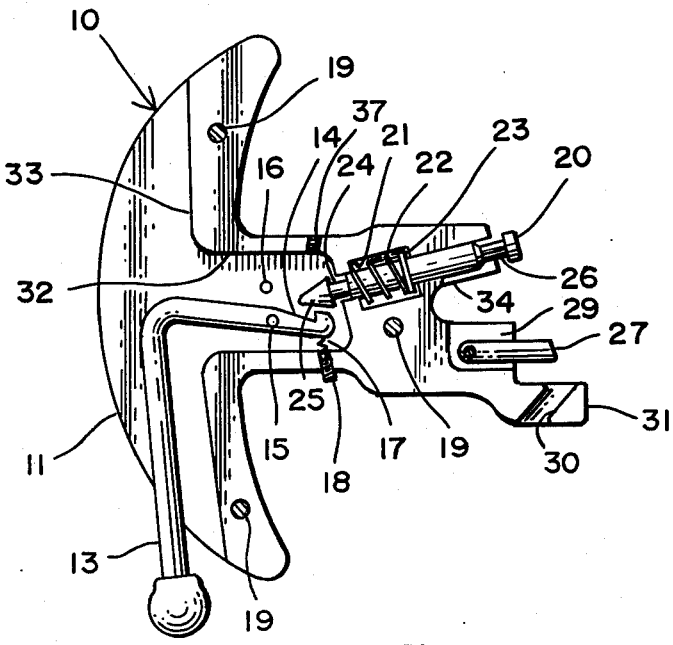
FIG. 3 shows the component parts of the mechanism in a second position or released position.
Figure 5:
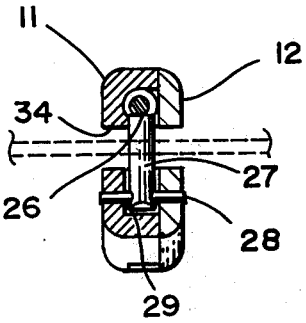
FIG. 5 is a front end view in cross section showing the holding member in a first position with the bowstring shown in broken lines.

Referring to the drawings by characters of reference, FIGS. 1–7 illustrate a bowstring draw and release device, 10.

The body 11 is made in the general shape of a T and is provided with several cavities to contain the various parts of the mechanism. The cavity 29 contains the bowstring holding member 27 which swings on pin 28. Cavity 21 contains the sliding retaining plunger 20 and compression spring 22. and the spring retaining ring 23. The cavity 32 is provided to contain the cone shaped end 25 of plunger 20, the groove 24 of plunger 20 and the trigger member 13 which pivots on pin 15. When the cover plate 12 is attached to the body 11 a slot 33 is formed for the operation on the trigger member 13. The cover plate 12 is fastened to the body 11 by the three screws 19.

The trigger member 13 as shown in the drawings is in a position so that it may be pulled by the third finger of the user's hand and pivots on pin 15. By removing the trigger member 13 from pin 15 and placing pin 15 in hole 16 the trigger member 13 may be placed in a turned over position over the pin now in hole 16. This causes the end of the trigger member 13 to protrude from the opposite side of the slot 33 so that the trigger member 13 may now be actuated by the thumb of the user's hand. The trigger notch 14 is held into engagement with the groove 24 of plunger 20 by pressure of the spring 17 and screw 18 when the trigger member is in the finger actuated position, and by the same means when the trigger member is in the thumb actuated position by moving the spring 17 and screw 18 to threaded hole 37.

Figure 4:
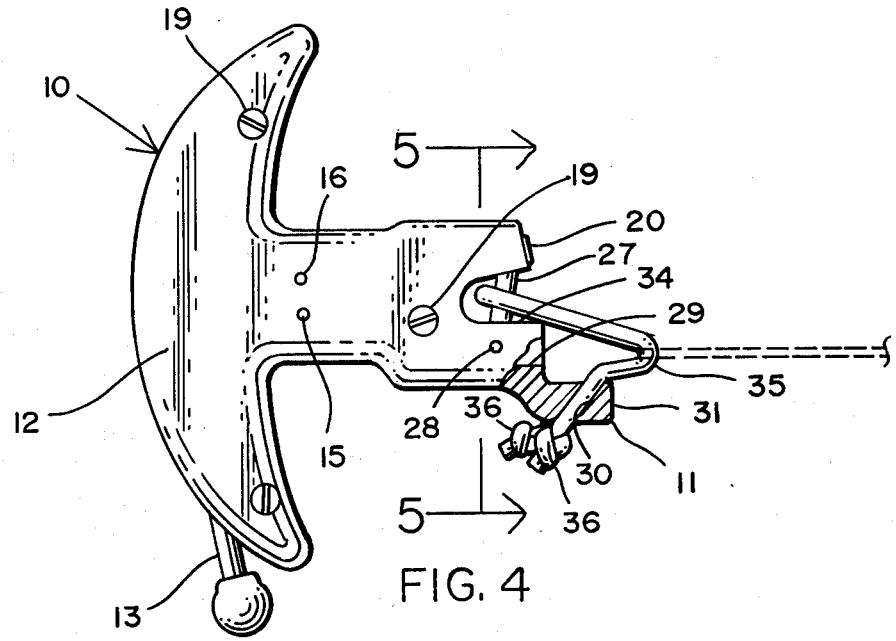
FIG. 4 shows the device in a first position with rope loop means attached and in a first position and holding a bowstring. The bowstring shown in broken lines.

When the loop 35 is used, it is placed in the bore 30 extending through the extension 31 of the body 11. the closed end of the rope loop 35 is passed around a bowstring and over the holding member 27 which is then pivoted into engagement with the groove 26 of retaining plunger 20. The closed end of loop 35 is then held in recess 34 by the holding member 27 until released. FIG. 4.

Figure 7:
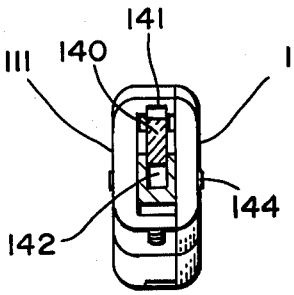
FIG. 7 shows a rear end view of the body of the model shown in FIG. 6 with the handle member and safety lever in cross section.
Figure 6:
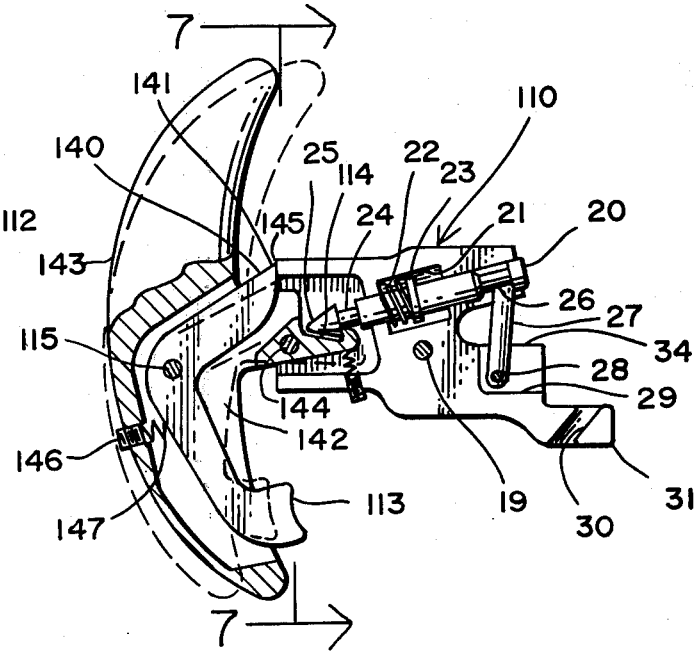
FIG. 6 shows the component parts of an alternate model of the device with the parts in a first position.

FIGS. 6–7 Illustrate a modification of the invention that allows the handle to be mounted on the trigger means.

In FIG. 6 the body 110 contains the component parts previously described except that trigger member 13 is now replaced by the trigger and handle means 143. The trigger notch 114 engages the groove 24 of plunger 20. Upon movement of the handle 143 the trigger notch 114 disengages the groove 24 of plunger 20 thereby releasing the holding member 27 and the bowstring. A safety lever 140 is mounted in a recessed portion of the handle 143 and pivots on the pin 115. One end of the safety lever projects from the handle, the other end engages the end surface 145 of the body 110, locking the handle in position to avoid accidental release. When the end 113 of the safety lever 140 is inwardly pressed into the handle 143, the other end surface 141 disengages the end surface 145 of the body 110 allowing the handle and trigger means to pivot out of engagement with the plunger 20. The safety lever is urged to a safe postion by the spring 147 which is held by the screw 146. The loop means 35 in FIG. 4 may be used with the modified device shown in FIG. 6.

OPERATION OF THE DEVISE

To attach the invention to a bowstring, it is necessary that the mechanism be in a released or second position. To do this, the trigger member 13 is pressed by the hand. The trigger notch 14 now disengages the groove 24 in the end of the plunger 20. The plunger 20 will now move forward under pressure of spring 22 and release the end of holding member 27 from the groove 26 of the plunger 20. The user now places the bowstring in the recess 34 and swings the holding member 27 back into engagement with the groove 26 of plunger 20. The plunger 20 is then pushed back into the body 11 against the pressure of spring 22 until the groove 24 of plunger 20 engages the trigger notch of trigger member 13. The mechanism is now in a cocked or first position.

With release device thus attached to a bowstring, the user now grips the device with his hand and draws the bowstring back. When the user is satisfied that his aim is proper, he presses back on the projecting end of the trigger member 13 with his finger. The trigger notch 14 now is disengaged with the groove 24 in the plunger 20 and the plunger 20 is pulled forward by the tension of the bowstring and the force of spring 22. When the retaining ring 23 reaches the end of cavity 21, the plunger 20 is brought to a stop. The groove 26 on the outer end of the plunger 20 now release the end of the holding member 27 allowing the holding member 27 to swing outward and release the bowstring.

When the rope loop means is used, the loop 35 is installed in the bore 30 of the body extension 31. The loop 35 is prevented from pulling through the bore 30 by the knotted ends 36. To use, the closed end of the loop means 35 is passed around the bowstring and over the holding member 27, FIG. 4, and the mechanism is moved to the first position as previously described. When the mechanism moves to a released position, the loop is released and is brushed aside by the bowstring as the bowstring propels the arrow to the target.

The modified model shown in FIGS. 6–7 except that as the handle is mounted on the trigger means, the release of the plunger 20 from the trigger notch 114 is actuated by a pivotal movement of the handle 143. A safety lever is featured which prevents the accidental release of the bowstring while the user is drawing the bowstring back. The end surface 141 of the lever 140 engages the end surface 145 of the body 111 and prevents the movement of the handle 143 in a releasing direction. When the user is ready to release the bowstring, the protruding end 113 of the safety lever 140 is pressed inward into the handle. The opposite end 141 then swings out of engagement with the end portion of the body 111 allowing the handle and the trigger means to move to a releasing position.

Although but a few embodiments of the invention have been shown and described, it will be apparent to those skilled in the art that various changes and modifications may be made therein without departing from the spirit of the invention or from the scope of the appended claims.

What is claimed is:

1. A bowstring holding and release mechanism comprising a holding and release means for releasably engaging a bowstring, said holding and release means comprising a swinging holding member for movement between first and second position for holding and releasing a bowstring, respectively, retaining plunger means slideably mounted on said holding and release means and engaging a first end portion of said holding member to retain said holding member in said first position when said retaining plunger is in a first position, triggering means engaging a first end portion of said retaining plunger means to retain said retaining plunger means in a first position when said triggering means is in a first pivoted position, said triggering means being pivotably moveable to a second position out of engagement with said end portion of said retaining plunger means to permit said retaining plunger means to slide to a second position out of engagement with said first end portion of said holding member to permit said holding member to swing to said second position for releasing a bowstring, said holding member when manually moved to said first position being engaged by said retaining plunger means and said retaining plunger means being engaged by said triggering means, spring means for holding said triggering means in said first position and for automatically returning said triggering means back to said first position after having been moved from a first position to a second position, an additional spring means for urging said retaining plunger toward said second position after having been moved from a second position to said first position, whereby said retaining plunger means holds said holding member in a first position when said retaining plunger means and said triggering means are in a first position and said bowstring is tensed and when said triggering means is moved to said second position said retaining plunger and said holding member move to said second position and said bowstring moves to a released position.

2. The structure as recited by claim 1 wherein said holding member is elongated and cylindrical in shape, mounted on a pivot pin at one end so that the other end may swing in and out of engagement with notch means mounted on one end of said retaining plunger means.

3. The structure as recited by claim 2 wherein said retaining plunger means is elongated with a cone shape on one end immediately adjacent to a groove providing shoulder means for engagement with said triggering means, and a groove formed in the other end for engaging and retaining said holding member when said holding member is in a first position.

4. The structure as recited by claim 3 taken in combination with rope loop means removably mounted on said holding and release means whereby when the closed end of said rope loop means is passed around a bowstring and said closed end of said rope loop means is placed over the end of said holding member and said holding member is moved to said first position, a bowstring is releasably held.

5. The structure as recited in claim 4 taken in combination with a handle means shaped to fit the user's hand mounted on said holding and release means.

6. The structure as recited by claim 1 taken in combination with handle means to fit the user's hand mounted on said triggering means whereby when pivotal movement is applied to said handle means said triggering means moves out of engagement with said retaining plunger means.

7. The structure as recited by claim 6 taken in combination with safety lever means comprising a lever member pivotally mounted on said handle means, a first end of said level member protruding from said handle means, and a second end portion engaging a surface portion of said holding and release means and preventing pivotal movement of said handle means when said lever means is in a first position, spring means urging said lever member toward said first position, whereby when pivotal movement is applied to said lever member said second end portion disengages said surface prtion of said holding and release means as said lever moves to a second position allowing pivotal movement of said handle means.

* * * * *